US009381743B2

(12) United States Patent
Creus et al.

(10) Patent No.: US 9,381,743 B2
(45) Date of Patent: Jul. 5, 2016

(54) COMPENSATING FOR CHANGES IN PRINTHEAD-TO-PRINTHEAD SPACING

(75) Inventors: Jordi Hernandez Creus, Granollers (ES); Yngvar Rossow Sethne, Sant Cugat del Valles (ES); Ignacio Picatoste Olloqui, Barcelona (ES); Jesús García Maza, Terrassa (ES); Francisco Guerrero Carvajal, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/426,116

(22) PCT Filed: Sep. 14, 2012

(86) PCT No.: PCT/EP2012/068075

§ 371 (c)(1),
(2), (4) Date: Jul. 8, 2015

(87) PCT Pub. No.: WO2014/040631

PCT Pub. Date: Mar. 20, 2014

(65) Prior Publication Data

US 2015/0321473 A1 Nov. 12, 2015

(51) Int. Cl.

| | |
|---|---|
| ***B41J 2/145*** | (2006.01) |
| ***B41J 2/21*** | (2006.01) |
| ***B41J 19/20*** | (2006.01) |

(52) U.S. Cl.

CPC ..... *B41J 2/145* (2013.01); *B41J 2/2135* (2013.01); *B41J 19/207* (2013.01)

(58) Field of Classification Search

CPC .. B41J 2/04563; B41J 2/0458; B41J 2/04581; B41J 2/04591; B41J 29/393

USPC ..... 347/5, 6, 8, 9, 14, 19, 20, 40

See application file for complete search history.

(56) References Cited

U.S. PATENT DOCUMENTS

| | | | | |
|---|---|---|---|---|
| 5,847,722 | A * | 12/1998 | Hackleman | B41J 2/1753 347/19 |
| 6,010,206 | A | 1/2000 | Simons | |
| 6,318,839 | B1 | 11/2001 | Elgee | |
| 6,390,588 | B1 | 5/2002 | Ikeda | |
| 2004/0046823 | A1 | 3/2004 | Allen et al. | |
| 2007/0024659 | A1 | 2/2007 | Grosse et al. | |
| 2009/0027438 | A1 * | 1/2009 | Tanaka | B41J 29/38 347/19 |
| 2010/0156976 | A1 * | 6/2010 | Seo | B41J 2/04505 347/14 |
| 2010/0295897 | A1 | 11/2010 | Naruse et al. | |

FOREIGN PATENT DOCUMENTS

JP 2000094718 4/2000

* cited by examiner

*Primary Examiner* — Manish S Shah
*Assistant Examiner* — Roger W Pisha, II
(74) *Attorney, Agent, or Firm* — HP Inc Patent Department

(57) ABSTRACT

According to one example, there is provided a system for compensating for changes in printhead-to-printhead spacing in a printing system having multiple printheads mountable on a printhead support. The system includes a measurement system to determine a change in printhead-to-printhead spacing between different ones of mounted printheads, and a processor to determine compensation to be applied to the printing system to compensate for the determined change in printhead-to-printhead spacing.

20 Claims, 3 Drawing Sheets

COMPENSATING FOR CHANGES IN PRINTHEAD-TO-PRINTHEAD SPACING

BACKGROUND

Inkjet printing systems typically comprise a printhead support on which are mounted multiple inkjet printheads. Each printhead comprises an array of printhead nozzles.

When multiple printheads are used in a printing system each printhead has to be accurately positioned relative to other printheads, such that nozzles on different printheads are precisely aligned relative to each other. This precision is to ensure that printhead control signals cause each nozzle of each printhead to fire, or to eject, an ink drop at a precise location on a media.

BRIEF DESCRIPTION

Examples, or embodiments, of the invention will now be described, by way of non-limiting example only, with reference to the accompanying drawings, in which:

FIG. 1*a* is a block diagram showing a portion of a printing system according to one example;

FIG. 1*b* is a block diagram showing a portion of a printing system according to one example;

DETAILED DESCRIPTION

Figure 1A:
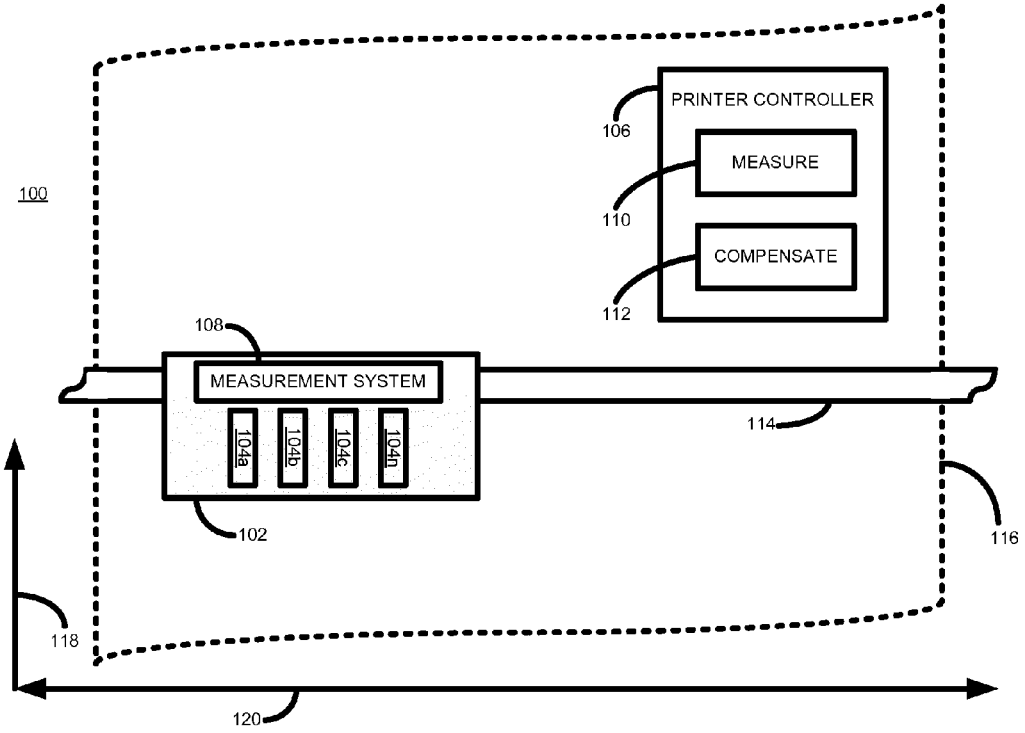

Referring now to FIG. 1 there is shown a portion of a printing system 100 according to one example. The printing system 100 comprises a printhead support 102 on which are mountable multiple printheads 104*a* to 104*n*. In one example the printheads 104 are inkjet printheads, such as thermal inkjet or piezo inkjet printheads. Each printhead may be used, for example, for printing coloured ink drops on a media.

Each printhead comprises multiple nozzles (not shown), arranged in an array configuration, through which ink drops may be ejected in response to printhead control signals sent to each printhead 104 by a printer controller 106. The printer controller 106 may, for example, derive or receive printhead control signals from digital data representing an image or a document to be printed.

In one example, as shown in FIG. 1*a*, the printhead support 102 may be a printhead carriage that moves, or scans, across along a carriage bar 114 along scan axis 120 to print a swath on a media 116. The media 116 may then be advanced in a media advance direction 118 to enable a further swath to be printed.

Figure 1B:
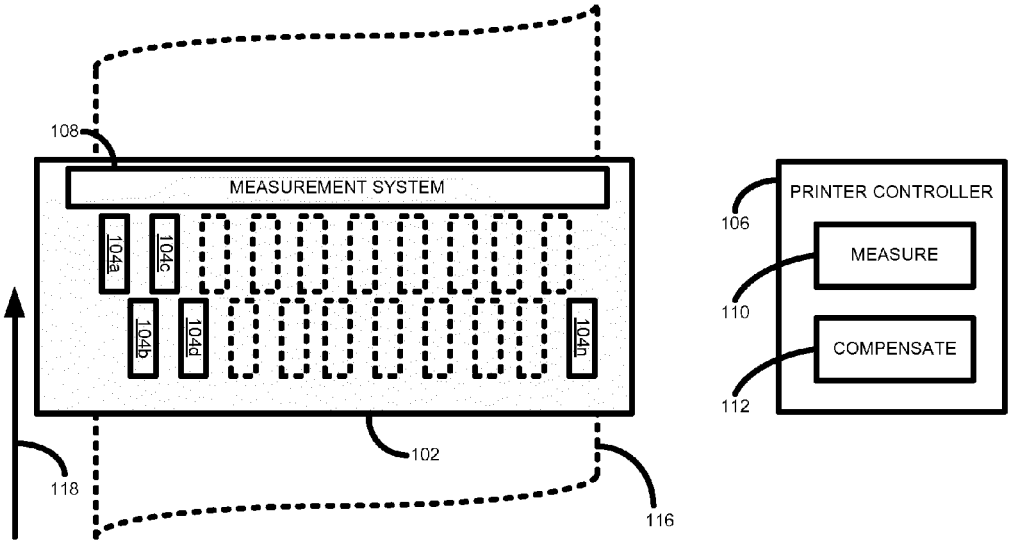

In another example, as shown in FIG. 1*b*, the printhead support may be a page-wide array support on which are mountable a number of printheads 104*a* to 104*n* in an array of printheads that span the whole, or substantially the whole, width of a media 116 on which printing is to be performed. The media 116 is advanced under the printhead support 102 in media advance direction 118.

In use, the temperature of the printhead support 102 may change. For example, after periods of use the printhead support 102 may heat up, and after periods of inactivity or reduced use the printhead support 102 may cool down.

The amount of heating and cooling may vary depending on the particular printer configuration. For example, in some printing systems heaters or lamps (not shown) may be mounted on, or in proximity to, the printhead support 102 for example for use in drying or curing ink ejected from a printhead.

Changes in temperature of the printhead support 102 may result in expansion or contraction of the printhead support 102. Depending on the material or materials used for the printhead support 102, the dimensions of the printhead support 102, and the operating temperature, the printhead support 102 may expand or contract by differing amounts. Expansion or contraction of the printhead support 102 may affect the spacing between different ones of the printheads, referred to hereinafter as printhead-to-printhead spacing.

In a multiple printhead printing systems even a small deviation in printhead-to-printhead spacing may result in noticeable image quality artifacts. For example, in a printing system that prints at a resolution of 600 dots per inch (dpi) printed image quality may be degraded when printhead-to-printhead spacing varies as little as 80 microns (equivalent to approximately 2 dots at 600 dpi).

To compensate for any changes in printhead-to-printhead spacing, examples of printing systems described herein include a measurement system 108 to measure any variation in printhead-to-printhead spacing, and a system for compensating for any such variation.

In one example, the measurement system 108 enables the distance between two locations on the printhead support 102 to be accurately determined. This enables variations in the distance between different ones of the printheads, such as a first printhead 104*a* and a second printhead 104*n*, to be determined. A compensation module 112 of the printer controller 106 is also provided to modify operation of the printing system such that print quality issues caused by any printhead-to-printhead spacing variation are reduced or eliminated.

In one example, where the printhead support 102 is a scanning printhead support, the compensation module 112 determines timing offset data to apply to a printhead firing data controller to modify the timing of one or multiple printhead nozzle firing signals on one or multiple ones of the printheads based on the measured variations of printhead-to-printhead spacing. The timing offset data ensures that ink drops are ejected with a suitable timing delay or timing advance such that the ejected ink drops are accurately positioned on a media.

In another example, where the printhead support 102 is a page-wide array printhead support, the compensation module 112 may generate signals to modify printhead nozzle redundancy based on the measured variations of printhead-to-printhead spacing. Printhead nozzle redundancy may, for example, enable nozzles on one printhead to be logically switched for redundant nozzles on the same printhead or for overlapping redundant nozzles of a different printhead.

Figure 2:
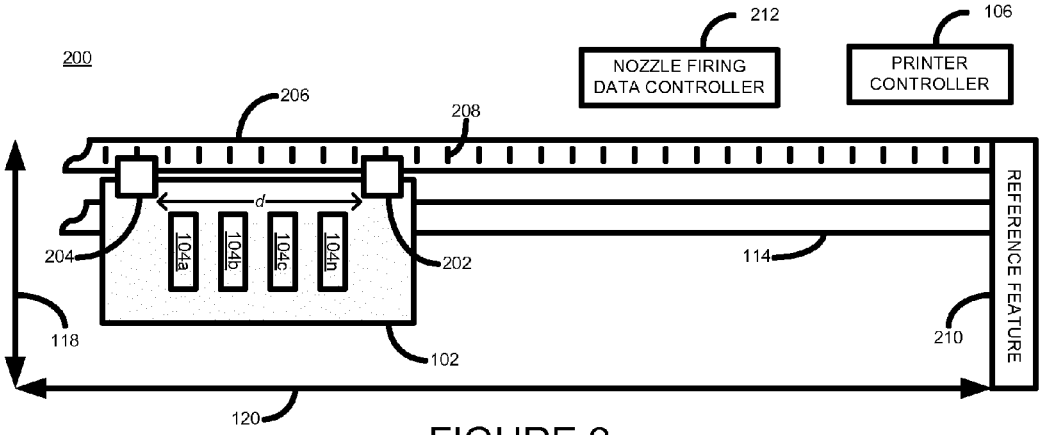
FIG. 2 is a block diagram showing a portion of a printing system according to one example.

Referring now to FIG. 2 there is a shown a portion of a printing system 200 according to one example.

The printing system 200 comprises a first encoder 202 and a second encoder 204.

The encoders 202 and 204 are mounted on the printhead support or carriage 102. The encoders 202 and 204 generate electrical signals in response to reading an encoder scale 208 on an encoder strip 206.

In one example the encoders 202 and 204 are optical encoders such as HEDS9720 encoders from Avago Technologies.

In the present example the encoders 202 and 204 generate electrical signals in response to light reflected from an optical encoder strip 206 on which an encoder scale 208 is disposed. In one example the encoder scale 208 has a resolution of 600 dpi (0.0042 mm).

In one example the encoder 202 generates electrical signals that allow the printer controller 106 to determine the position of the carriage 102 along the carriage bar 114.

Although the encoder strip 206 and carriage bar 114 are shown as separate elements, in other examples the encoder strip may be integrated with the carriage bar, with the encoders 202 and 204 appropriately positioned to read the encoder strip on the carriage bar.

In one example the encoder strip 206 enables the printer controller 106 to determine a position of the carriage 102 along the carriage bar 114. In this example, before the controller 106 can determine the position of the carriage 102 along the carriage bar 114 the controller 106 moves the carriage 102 to abut a reference feature 210 position at a predetermined reference position towards one end of the carriage bar 114. Once the carriage 102 has been moved against the reference feature 210 any further movement of carriage will allow the printer controller 106 to determine the position of the carriage 102 along the carriage bar 114 relative to the reference feature 210. The degree of accuracy to which the position of the carriage 102 may be determined is based on the encoder scale 208.

In one example the encoder 202 is used to enable the printer controller 106 to determine the position of the carriage 102 along the carriage bar 114 for use in general printing operations, such as controlling the timing of printhead nozzle firing data to ensure that ink drops are accurately placed on a media during a printing operation as the carriage 102 moves across the carriage bar 114.

In the present example, the addition of the second encoder 204, located on the carriage 102 towards the other end of the carriage 102, with one or more of the printheads 104 located in between the first and second encoder 202 and 204, enables the printer controller 106 to determine any change in the distance d between the two encoders 202 and 204.

For example, if the carriage 102 expands in its longitudinal direction, the distance d, and hence the distance between the two encoders 202 and 204, will increase. Based on the electrical signals generated by each encoder 202 and 204 in response to the encoder strip 206, the printer controller 106 can determine the amount of change in the distance d.

For example, if the carriage 102 is at an ambient temperature of around 20 degrees Celsius and is moved from the reference feature 210 to a given position on the carriage bar 114 the first encoder 202 may generate 1000 electrical impulses, and the second encoder 204 may generate 21000 electrical impulses. If, when the carriage 102 has warmed up to a higher temperature of, for example, 40 degrees Celsius, and is moved from the reference feature 210 to a given position on the carriage bar 114 the first encoder 202 may generate 1000 electrical impulses, and the second encoder 204 may generate 21004 electrical impulses. In this example, this controller 106 determines that the distance d has increased by about 80 microns.

One advantage of this example, for printing systems that already use an encoder on a carriage to determine the position of the carriage along a carriage bar, is that determination of the distance d may be achieved with the addition of only a single encoder and the addition of an additional module in a printer controller 106.

Figure 3:
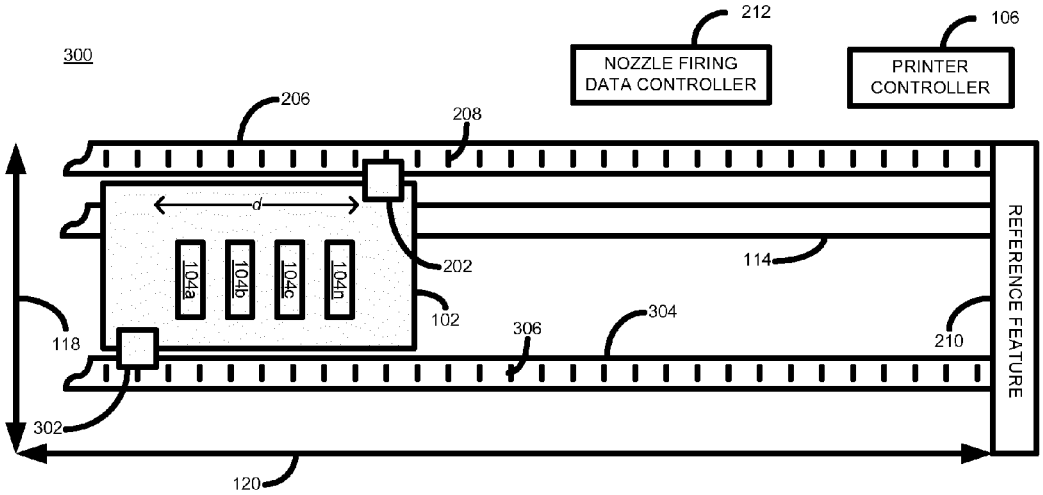
FIG. 3 is a block diagram showing a portion of a printing system according to one example.

FIG. 3 shows a further example 300 in which the second encoder 302 reads a second encoder strip 304 having a second encoder strip scale 306. In this example the second encoder strip 304 uses the same scale as the first encoder strip 206, although in another example a different encoder strip scale may be used.

Figure 4:
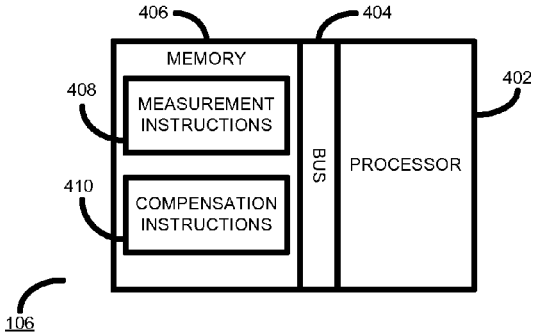
FIG. 4 is a block diagram showing a printer controller in greater detail according to one example.

A more detailed view of the printer controller 106 is shown in FIG. 4.

The printer controller 106 comprises a processor 402, such as a microprocessor or microcontroller, and a memory 406 coupled to the processor 402 by a communications bus 404. The memory 406 stores processor executable measurement instructions 408 and processor executable compensation instructions 410 that, when executed by the processor 402 cause the controller 106 to determine changes in the printhead-to-printhead spacing and cause the controller 106 to compensate for any such changes, as described herein.

Figure 5:
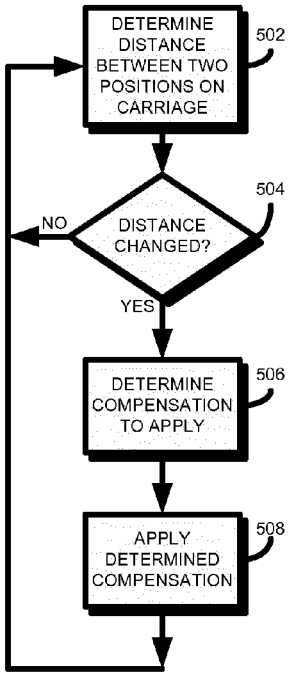
FIG. 5 is a flow diagram outlining an example method of operating a portion of a printing system according to one example.

An example method performed by the controller 106 is outlined in the flow diagram of FIG. 5.

At block 502 the controller 106 determines the distance d between two predetermined locations on the carriage 102. As previously described, the distance d may be determined through use of a pair of encoders on the carriage 102.

At block 504 the controller 106 determines whether the determined distance d has changed since the previous time it was determined. If not, the distance d is determined again after a short delay. In one example the distance d may be determined once a second, once a minute, or at any suitable period.

At block 506 the controller 106 determines compensation to apply to the printing system to compensate for any change in the distance d.

In one example, it may be assumed that the carriage 102 expands and contracts in a linear manner in its longitudinal dimension in response to changes in temperature. If, for example there are N equally spaced (at ambient temperature) printheads mounted on the carriage, it may be assumed that changes in distance d affects the spacing between each of the N printheads in a linear manner. Thus, in one example the controller 106 determines that the spacing between each of the N printheads changes by $$\frac{d}{N-1}$$

Thus, if there are four printheads and it is determined that distance d has increased by 300 microns, the controller 106 will determine that the printhead-to-printhead spacing has increased by 100 microns. The controller 106 then applies (block 508) the determined compensation to the printing system.

In one example, the controller 106 applies the determined compensation by providing a timing offset to a printhead firing data controller 212 to alter the timing of nozzle firing data for one or multiple ones of the printheads by an appropriate amount. The amount may be based, for example, on the determined change in printhead-to-printhead distance.

In a further example, if it is determined, for example through testing, that the carriage 102 does not expand and contract in a linear manner in its longitudinal dimension in response to changes in temperature, precise measurements may be made of the carriage to determine data describing the thermal expansion/contraction behavior of the carriage 102. This data may be stored in a lookup table and used by the controller 106 in determining an appropriate compensation, or correction factor, to apply to each printhead in response to a determined change in the printhead-to-printhead spacing.

Although the above examples use optical encoders, in other examples other non-optical encoders, such as induction encoders, magnetic encoders, capacitive encoders, or the like may be used. In such examples, an appropriate encoder strip or encoding arrangement may be used.

Figure 6:
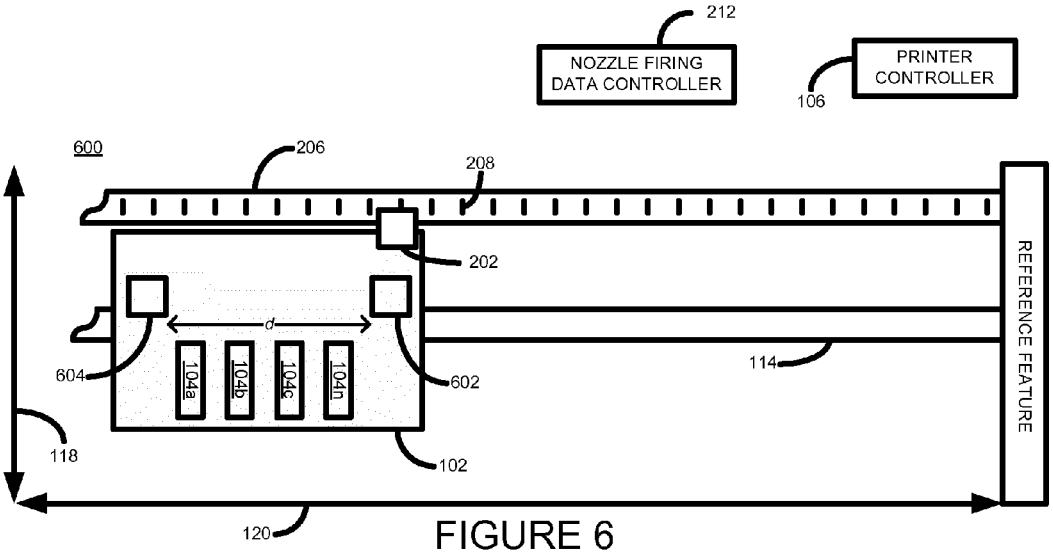
FIG. 6 is a block diagram showing a portion of a printing system according to one example.

Referring now to FIG. 6, there is shown a block diagram of a portion of a printing system 600 according to a yet further example.

In this example a measuring system comprising a pair of distantly located elements 602 and 604 is included on the carriage 102. In this example the elements 602 and 604 are included in addition to an encoder 202 and an encoder strip 206.

In one example measuring element 602 comprises a wave emitter and receiver, and element 604 comprises a wave reflector. For example, measuring element 602 may comprise a light emitting source and a light detector for detecting light reflected by the reflector 604. In another example, measuring element 602 may comprise a microwave or sound wave generator and measuring element 604 may comprise a microwave or sound wave reflector.

In a further example the measuring element 602 may comprise a wave emitting device, and the measuring element 604 may comprise a wave receiving device.

The measuring elements 602 and 604 enable the distance d between the two measuring elements to be accurately measured by measuring the time between an emitted wave and a received wave.

In one example the measuring element 602 and 604 form a laser distance measuring system.

As previously described above, the controller 106 determines (block 502) the distance d from the measuring system, and can determine a corresponding change in printhead-to-printhead spacing. The controller 106 then determines (block 506) the compensation to be applied, and applies (block 508) the determined compensation.

In some examples, an encoder strip may be constructed from a material or composition of materials having a low thermal expansion coefficient, such as plastic or paper.

In some examples where heaters or lamps are located on the printhead support 102, the effects of thermal expansion of an encoder strip may not be considered be significant compared to the thermal expansion of the printhead support, especially in large-format printing systems having a scanning printhead carriage. In such systems a carriage bar may be in the order of 1 m or more in length. Accordingly, due to the time taken for the carriage (with any heaters/lamps) to scan along the length of the carriage bar any heat absorbed by the encoder strip will have the time to largely dissipate prior to the carriage returning.

Although the examples above describe systems in which the distance between an array of printheads on a carriage is measured, in other examples the measuring system may not measure a distance between all of the printheads on the carriage. For example, in one example the measuring system may be arranged to measure only a distance between a subset of the printheads on a carriage. In this case, the compensation module may be configured to infer, for example through use of a suitable look-up table, a compensation factor to apply for each of the printheads on a carriage when it is determined that expansion or contraction has occurred.

It will be appreciated that examples and embodiments of the present invention can be realized in the form of hardware, software or a combination of hardware and software. As described above, any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples of the present invention. Examples of the present invention may be conveyed electronically via any medium such as a communication signal carried over a wired or wireless connection and examples suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A system for compensating for changes in printhead-to-printhead spacing in a printing system having multiple printheads mountable on a printhead support, the system comprising:

a measurement system to determine a change in printhead-to-printhead spacing between different ones of mounted printheads; and a processor to determine compensation to be applied to the printing system to compensate for the determined change in printhead-to-printhead spacing.

2. The system of claim 1, wherein the printhead support is moveable along a carriage bar in a scanning axis, and wherein the measuring system comprises a first encoder spaced apart from a second encoder along the scanning axis, the first and second encoders arranged to generate electrical signals in response to reading an encoder strip as the printhead support moves along the carriage bar.

3. The system of claim 2, wherein the processor determines a change in printhead-to-printhead spacing based on electrical signals generated by the first and second encoders.

4. The system of claim 1, the processor to further apply the determined compensation to the printing system to compensate for the determined change in printhead-to-printhead spacing.

5. The system of claim 2, wherein the first encoder is used by the printing system to determine a position of the printhead support along the carriage bar in order to control printhead nozzle firing data.

6. The system of claim 2, wherein the second encoder is arranged to read a same encoder strip as the first encoder.

7. The system of claim 2, wherein at least some of the printheads when mounted are located between the first and the second encoder.

8. The system of claim 3, wherein the processor is configured to determine a change in printhead-to-printhead spacing based in part on the determined change in distance between two positions on the printhead support, and in part on a predefined lookup table.

9. The system of claim 3, wherein the measuring system comprises a wave emitter and a wave receiver, and wherein the processor is configured to determine a change in distance between two positions on the printhead support by measuring the time between a wave being emitted by the wave emitted and a wave being received by a wave receiver.

10. The system of claim 1, wherein the processor is further configured to:

determine compensation in the form of timing offset data, the timing offset data based on the determined change in printhead-to-printhead spacing.

11. The system of claim 10, further comprising a printhead firing data controller to control a timing of firing data to nozzles of each printhead, and the processor to apply the determined timing offset data to the printhead firing data controller to modify a timing of a printhead nozzle firing signal.

12. A method of compensating for changes in printhead-to-printhead spacing in a printing system, the method comprising:

determining a change in distance between two positions on a printhead support;

determining a corresponding change in the spacing of printheads on the printhead support;

determining timing offset data to modify the timing of one or multiple printhead nozzle firing signals based on the measured variations of printhead-to-printhead spacing; and modifying the timing of printhead firing data in accordance with the determined timing offset;

wherein the printhead support is moveable along a carriage bar in a scanning axis, and wherein the determining a change in distance comprises:

determining, as the printhead support moves along the carriage bar, a difference between a number of electrical impulses generated by a first encoder located at a first position on the printhead support and a number of electrical impulses generated by a second encoder located at a second position on the printhead support, the impulses being generated by each encoder in response to reading an encoder strip.

13. The method of claim 12, wherein the step of determining a change in distance comprises emitting a wave from one location on the printhead support, receiving the emitted wave at a second location on the printhead support, and calculating the distance between the first and second location based on the time taken for the wave to travel from the first to the second location.

14. The method of claim 12, wherein the step of determining a change in printhead-to-printhead spacing further comprises:

determining a change in distance between two positions on a printhead support comprises determining; and applying a correction factor defined in a predefined lookup table.

15. A printing system, comprising a plurality of printheads mounted on a printhead support, wherein the printhead support is moveable along a carriage bar in a scanning axis;

a measurement system comprising a plurality of encoders to determine a change in printhead-to-printhead spacing between different ones of mounted printheads; and a processor to:

determine a change in printhead-to-printhead spacing based on electrical signals generated by a first and second encoder among the plurality of encoders, the first and second encoders arranged to generate electrical signals in response to reading an encoder strip as the printhead support moves along the carriage bar; and determine compensation to be applied to the printing system to compensate for the determined change in printhead-to-printhead spacing.

16. The printing system of claim 15, wherein the first encoder is used by the printing system to determine a position of the printhead support along the carriage bar in order to control printhead nozzle firing data.

17. The printing system of claim 15, wherein the second encoder is arranged to read a same encoder strip as the first encoder.

18. The printing system of claim 15, the processor to further determine timing offset data, the timing offset data based on the determined change in printhead-to-printhead spacing.

19. The printing system of claim 18, further comprising a printhead firing data controller to control a timing of firing data to nozzles of each printhead, and the processor to apply the determined timing offset data to the printhead firing data controller to modify a timing of a printhead nozzle firing signal.

20. The printing system of claim 15, wherein the first encoder comprises an electromagnetic wave emitter and the second encoder comprises an electromagnetic wave receiver.

* * * * *